United States Patent [19]

Mon

[11] Patent Number: 4,974,749

[45] Date of Patent: Dec. 4, 1990

[54] DRIPLESS MEASURING CUP FOR CLOSURE ASSEMBLY

[75] Inventor: Thomas K. Mon, Elizabeth, N.J.

[73] Assignee: Colgate-Palmolive Co., Piscataway, N.J.

[21] Appl. No.: 272,573

[22] Filed: Nov. 16, 1988

[51] Int. Cl.[5] ..... B65D 47/40

[52] U.S. Cl. ..... 222/111; 141/381; 222/109; 222/571

[58] Field of Search ..... 222/108–111, 222/562, 571; 141/381; 215/228, DIG. 7; 220/DIG. 5

[56] References Cited

U.S. PATENT DOCUMENTS

| | | | |
|---|---|---|---|
| 2,185,699 | 1/1940 | Zeugner . | |
| 2,763,402 | 9/1956 | Livingstone . | |
| 2,763,403 | 9/1956 | Livingstone | 222/111 |
| 3,240,404 | 3/1966 | Porter et al. . | |
| 3,319,842 | 5/1967 | Miller . | |
| 3,339,772 | 9/1967 | Miller . | |
| 3,361,307 | 1/1968 | Clare . | |
| 3,563,422 | 2/1971 | Cruikshank . | |
| 3,980,211 | 9/1976 | Owens . | |
| 4,133,462 | 1/1979 | Lindstrom . | |
| 4,253,459 | 3/1981 | Willis . | |
| 4,261,475 | 4/1981 | Babiol . | |
| 4,264,022 | 4/1981 | Perne et al. . | |
| 4,550,862 | 11/1985 | Barker et al. . | |
| 4,566,508 | 1/1986 | Bowyer | 141/381 |
| 4,696,416 | 9/1987 | Muckenfuhs et al. | 222/109 |
| 4,706,829 | 11/1987 | Li . | |
| 4,773,560 | 9/1988 | Kittscher | 222/109 |
| 4,830,234 | 5/1989 | Odet | 222/109 X |

FOREIGN PATENT DOCUMENTS

| | | | |
|---|---|---|---|
| 0052059 | 5/1982 | European Pat. Off. . | |
| 0109704 | 5/1984 | European Pat. Off. . | |
| 0132875 | 2/1985 | European Pat. Off. . | |
| 0297967 | 1/1989 | European Pat. Off. | 222/109 |
| 8431343 | 9/1985 | Fed. Rep. of Germany . | |
| 1407057 | 11/1965 | France . | |
| 2442196 | 6/1980 | France . | |
| 2493274 | 5/1982 | France | 215/DIG. 1 |

*Primary Examiner*—Kevin P. Shaver

*Attorney, Agent, or Firm*—Michael J. McGreal; Murray M. Grill; Robert C. Sullivan

[57] ABSTRACT

A dripless closure assembly for a container comprising a body seated in the neck of the container and which has a pouring spout. A measuring cup which also functions as a cap is disposed over the pouring spout and has a first threaded outwardly disposed skirt for threaded engagement with the neck of the container. A second skirt inward of the outer skirt and extending into the body is provided for eliminating dripping on the threads.

8 Claims, 3 Drawing Sheets

DRIPLESS MEASURING CUP FOR CLOSURE ASSEMBLY

BACKGROUND OF THE INVENTION

1. Field of the Invention

This invention relates to a closure device for a liquid container and, more particularly, to a drip-proof measuring cup for a container equipped with a pouring spout.

2. Description of the Prior Art

Previous closures with pouring spouts and measuring cups which served also as caps had been devised such as that shown in German Utility Model Patent No. G 84 31 343 9. However, while the measuring cup extended into the pouring spout body, spillage from the measuring cup sometimes caused contamination with the product in the container. Since these devices are especially adapted for use with laundry products, such as liquid detergents, softeners, bleach and the like, contamination of the threaded skirt could cause seepage along the container making the closure and container very slippery and difficult to handle—besides being unappealing to the user.

SUMMARY OF THE INVENTION

The present invention contemplates using a second skirt inwardly of an outwardly disposed internally threaded skirt both of which depend from a flange on a measuring cup or cap, which outward skirt is threaded over the neck of a container with the second skirt extending into the body of a pouring spout body.

DETAILED DESCRIPTION OF THE INVENTION

Figure 4:
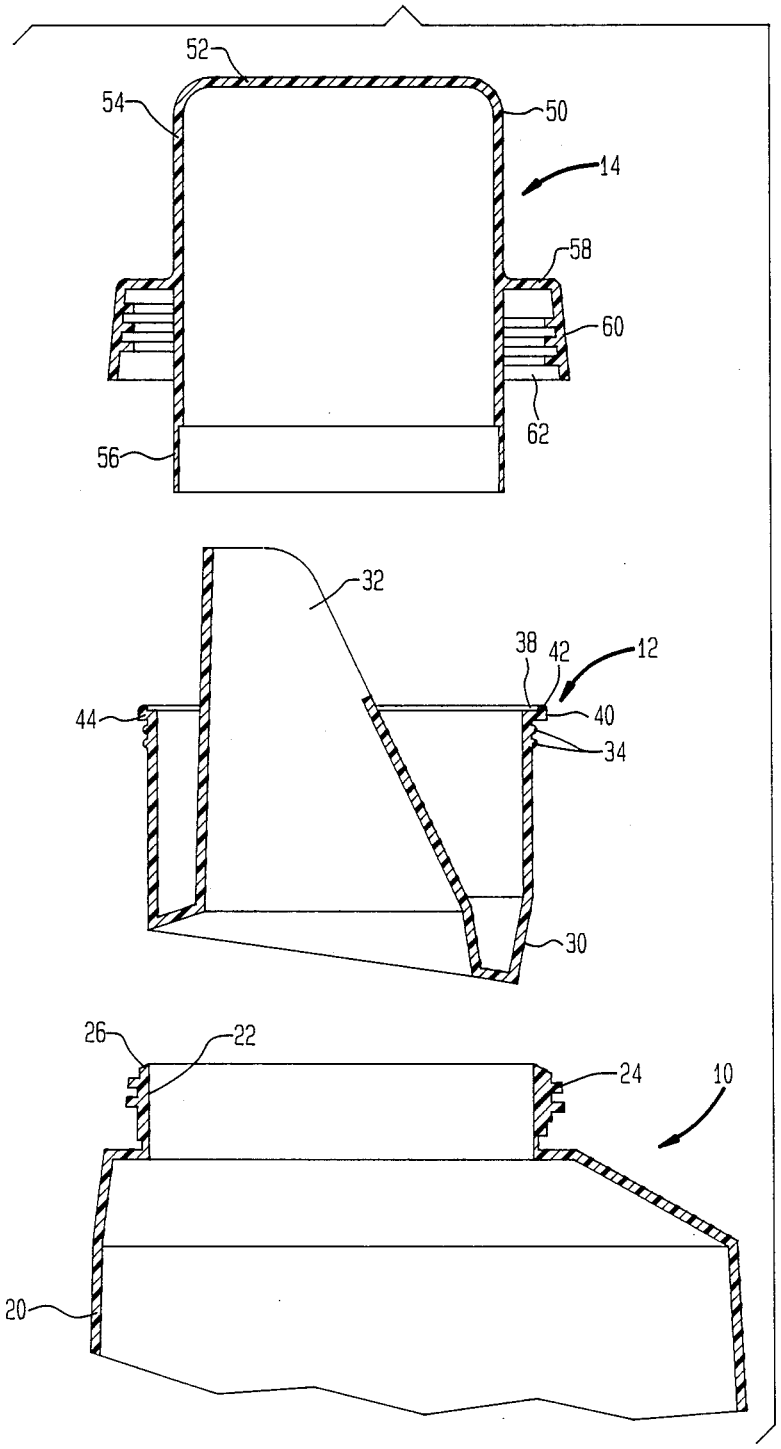
FIG. 4 is an explosed sectional detail view of the clsoure assembly.

With continuing reference to the accompanying drawing, wherein like reference numerals designate similar parts throughout the various views, and with initial attention directed to FIG. 4, there is shown for use with a container 10, a closure assembly including a first member 12 and a second member 14.

The container 10 is preferably blow-molded of a synthetic plastic material compatible with the contents for which it is to be used, such as laundry detergents, bleaches and fabric softeners, potable beverages or any other useful liquid material.

The container 10 includes a main portion 20, which has a neck 22. The neck 22 is externally threaded as at 24. The neck 22 has an upper peripheral edge 26.

Referring now to the first member 12, there is provided a tapered body 30, which is of a truncated conical configuration, extending downwardly and inwardly. Integral with the body 30 is a pouring spout of any selected and desired shape. On the upper outside surface of the body 30 there is provided suitable prongs or ribs 34, which form a seal seating the body 30 in the neck 22.

The upper peripheral edge 38 of the body 30 is provided with a peripheral lip 40, which seats on the upper edge of the neck 22.

The entire first member 12 is integrally molded from a synthetic plastic material commensurate with the contents of the container 20.

The second member 14 includes a measuring cup 50, which has a top portion 52 and a cylindrical side wall 54 which terminate in a lower end 56. Integral with the side walls 54 is an outwardly extending radial flange 58, which has integrally molded therewith a downwardly extending skirt 60 coaxial with the wall 54. The skirt 60 is internally threaded at 62.

Figure 1:
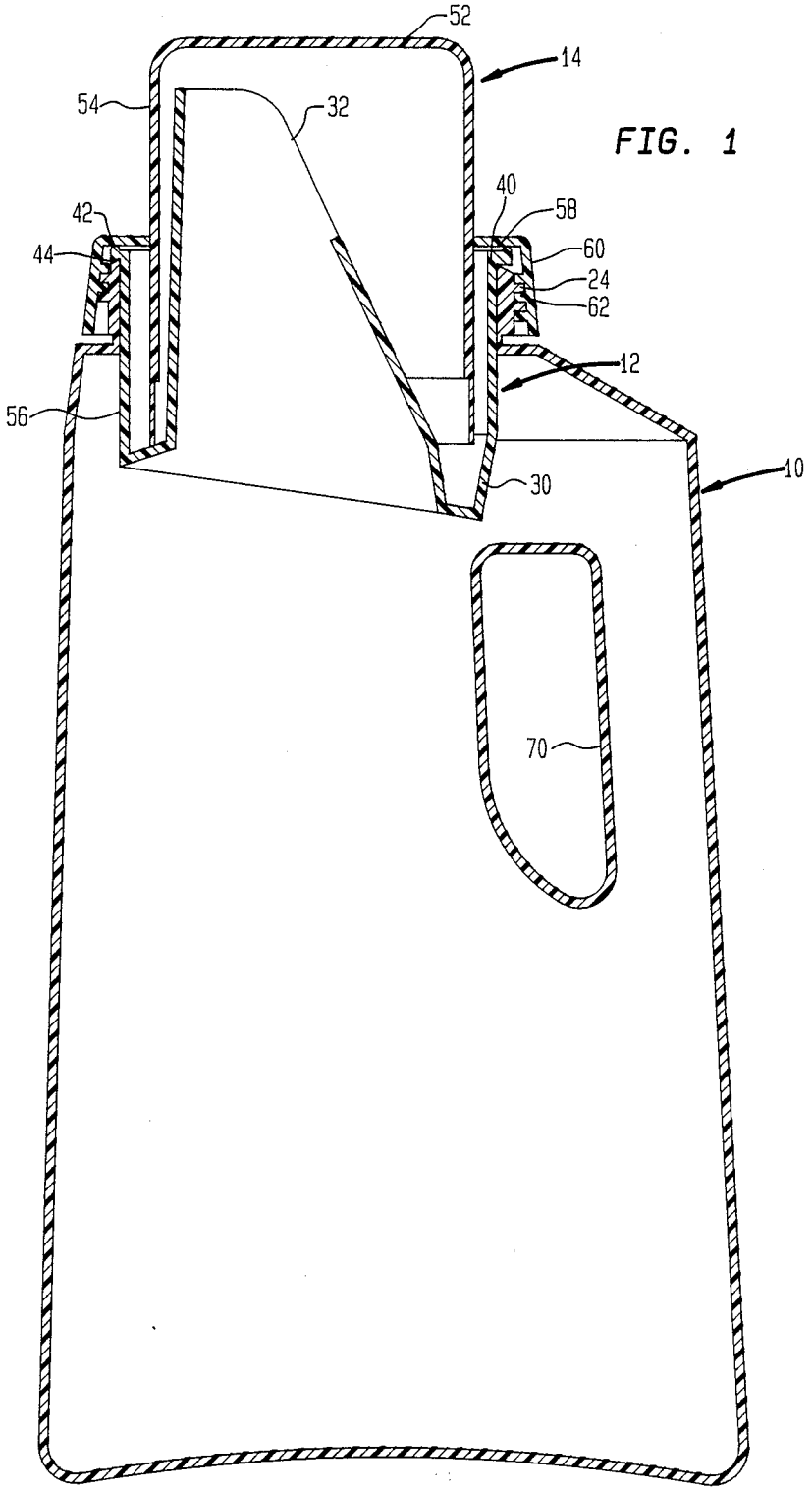
FIG. 1 is a vertical sectional view of the closure assembly as installed on a container.
Figure 2:
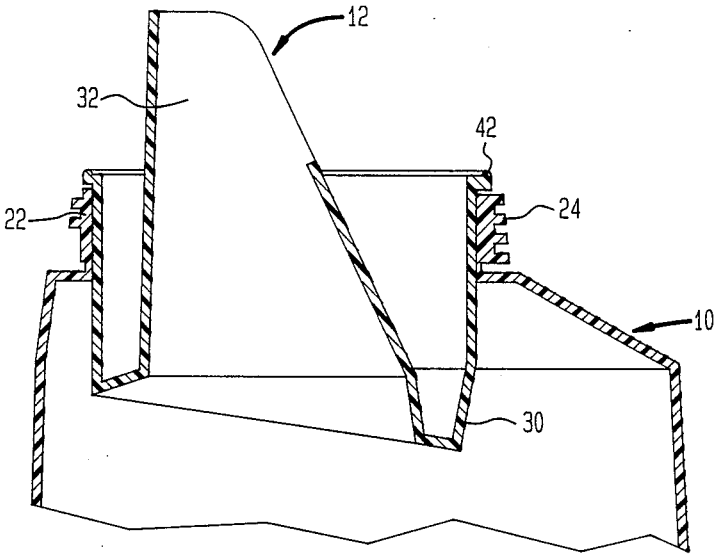
FIG. 2 is a vertical sectional view of the closure device and a portion of the container, with the combination measuring cup and cap removed.
Figure 3:
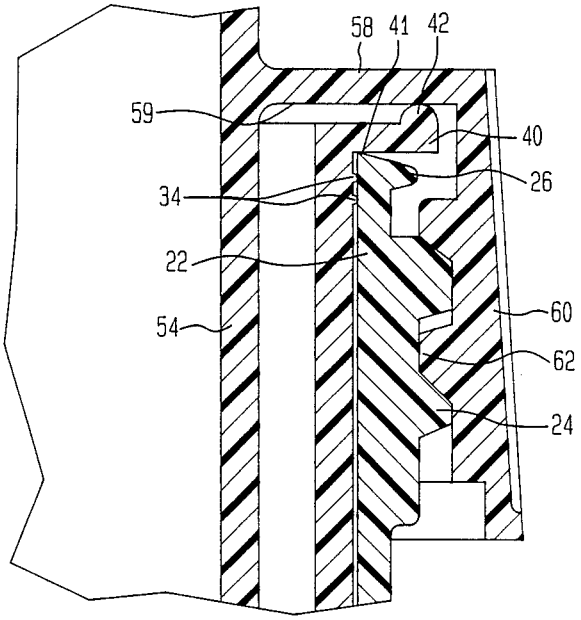
FIG. 3 is an enlarged sectional detail view illustrating the closure assembly in its closed position.

As can be seen in FIG. 2, the closure assembly is especially adapted for large containers, such as are commonly used for laundry materials, and which may have an integrally molded handle 70 and are quite heavy when filled with liquid. In order to ensure against contamination of the threads 62, there is provided a second skirt 80 coaxial with the skirt 60 and wall 54. This skirt terminates above the lower end of wall 54, but extends below the skirt 60.

The first member 12 is pressed into the neck 22. Then, the second member is threaded in place allowing the skirt 80 to extend into the body 30.

What is claimed is:

1. A closure assembly for a container having an externally threaded neck comprising a pouring spout having a body portion receivable within said neck, said body portion having an outwardly peripheral lip, and a measuring cup forming means for closing said container, threaded means on said measuring cup for engaging said threaded neck, said threaded means including an outwardly extending flange intermediate the ends of said measuring cup and having a downwardly depending internally threaded skirt, and a second skirt between said threaded skirt and the wall of said measuring cup extending downwardly from said flange and extending into said body portion.

2. A closure assembly according to claim 1, wherein said second skirt lies close to said measuring cup wall.

3. A closure assembly according to claim 1, wherein said second skirt is coaxial with said measuring cup and said threaded skirt.

4. A closure assembly according to claim 1, wherein said second skirt extends downwardly below said threaded skirt.

5. A closure assembly according to claim 1, wherein said second skirt lies close to said measuring cup, said second skirt extending below said threaded skirt.

6. A closure assembly according to claim 2, wherein said second skirt is coaxial with said threaded skirt.

7. A closure assembly according to claim 1, wherein said second skirt is coaxial with said measuring cup wall and said threaded skirt, said second skirt extending below said threaded skirt.

8. A closure assembly according to claim 7, wherein said measuring cup extends below said second skirt and into said body.

* * * * *